United States Patent [19]

Rossomme et al.

[11] 4,421,557

[45] Dec. 20, 1983

[54] AUSTENITIC STAINLESS STEEL

[75] Inventors: Paul A. Rossomme, Midland; John J. Eckenrod, Coraopolis; Curtis W. Kovach; Kenneth E. Pinnow, both of Pittsburgh, all of Pa.

[73] Assignee: Colt Industries Operating Corp., Pittsburgh, Pa.

[21] Appl. No.: 436,873

[22] Filed: Oct. 26, 1982

Related U.S. Application Data

[63] Continuation-in-part of Ser. No. 170,364, Jul. 21, 1980, abandoned.

[51] Int. Cl.[3] ..... C22C 38/16; C22C 38/20; C22C 38/22; C22C 38/42

[52] U.S. Cl. ..... 75/125; 75/128 B; 75/128 C; 75/128 G; 75/128 N; 148/38

[58] Field of Search ..... 75/125, 128 A, 128 E, 75/128 N, 128 W; 148/38

[56] References Cited

U.S. PATENT DOCUMENTS

| | | | |
|---|---|---|---|
| 2,553,330 | 5/1951 | Post et al. | 75/128 E |
| 4,078,920 | 3/1978 | Liljas | 75/128 E |
| 4,204,862 | 5/1980 | Kodo et al. | 75/128 E |
| 4,224,062 | 9/1980 | Darnfors | 75/128 E |
| 4,329,173 | 5/1982 | Culling | 75/128 A |
| 4,371,394 | 2/1983 | Henthorne et al. | 75/128 A |

FOREIGN PATENT DOCUMENTS

| | | | |
|---|---|---|---|
| 52-42417 | 4/1977 | Japan | 75/125 |
| 57-26151 | 2/1982 | Japan | 75/128 A |
| 773134 | 10/1980 | U.S.S.R. | 75/128 A |

*Primary Examiner*—Michael L. Lewis
*Attorney, Agent, or Firm*—Clair X. Mullen, Jr.

[57] ABSTRACT

An austenitic stainless steel having good corrosion resistance, particularly in chloride environments; this is achieved by the use of a rare earth element, preferably lanthanum, singly or in combination with nitrogen, along with nickel and molybdenum at relatively low levels for an austenitic stainless steel. The composition includes 15 to 25% chromium, greater than 16 to 25% nickel, 3 to 7% molybdenum, with a rare earth element consisting of lanthanum within the range of 0.005 to 0.05% in combination with 0.1 to 0.5% nitrogen.

9 Claims, 1 Drawing Figure

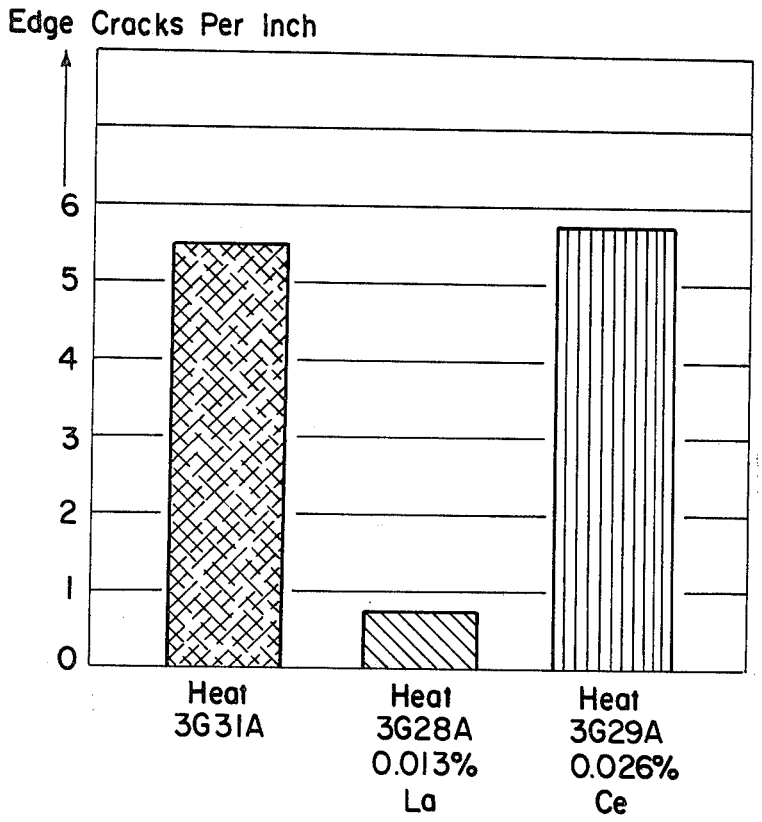
Edge Cracks Per Inch
6
5
4
3
2
1
0
Heat 3G31A
Heat 3G28A 0.013% La
Heat 3G29A 0.026% Ce

AUSTENITIC STAINLESS STEEL

This is a continuation-in-part of Patent Application Ser. No. 170,364, filed July 21, 1980 now abandoned.

There is a need for highly corrosion resistant stainless steels for use broadly in marine and severe chemical environments. More specifically, construction of power and chemical plants that utilize seawater for coolants, recent developments in the pulp and paper industry that increase the chloride concentrations in these applications and the installation of pollution control equipment have created applications for stainless steels that are more corrosion resistant than the conventional AISI Type 304 and Type 316 stainless steels.

For these applications, and particularly to provide corrosion resistance in chloride-type environments, it is known to use stainless steels having relatively high combinations of nickel and molybdenum. Nickel and molybdenum in recent years have become increasingly more expensive so that a need exists for a stainless steel having the required corrosion resistance in chloride environments without resorting to higher nickel and/or molybdenum contents to achieve this.

It is accordingly the primary object of the present invention to provide an austenitic stainless steel having good corrosion resistance in chloride environments, wherein nickel and molybdenum are maintained at relatively low levels and the rare earth element lanthanum is used in combination with nitrogen to enhance corrosion resistance and hot-workability.

This and other objects of the invention, along with a more complete understanding thereof, may be obtained from the following description, specific examples and drawing.

The single FIGURE of the drawing is a bar graph showing the criticality of lanthanum compared to cerium in the alloy of the invention from the standpoint of hot-workability, and specifically hot-workability.

Broadly, the composition of the austenitic stainless steel in accordance with the present invention consists essentially of, in weight percent, 0.01 to 0.1 carbon, manganese 12 max., preferably 3 max., silicon 1 max., chromium 15 to 25, preferably 17 to 23, nickel greater than 16 to 25, preferably greater than 16 to 20, molybdenum 3 to 7, preferably 3 to 5.5, lanthanum within the range of 0.005 to 0.05, nitrogen 0.1 to 0.5, preferably 0.1 to 0.3, and the balance iron.

Copper may be added for acid corrosion resistance in amounts up to about 3%.

It is understood that for stabilization purposes and depending upon the carbon and nitrogen content of the alloy conventional stabilizing elements such as titanium, columbium, vanadium, zirconium and tantalum may be present alone or in combination. Also, the conventional deoxidizers such as aluminum, calcium, boron and magnesium may be used. With respect to the composition recited in the claims, these are considered to be incidental elements and their use for stabilization and deoxidation, respectively, is considered to be within the scope of the claims. It is also understood that for purposes of providing good hot workability and resistance to weld hot cracking, elements known to be detrimental to these properties, such as sulfur, phosphorus, lead, and tin may be controlled to very low levels.

For purposes of defining the limits of the invention, and by way of specific example thereof, six 50-pound vacuum induction heats were melted. These heats contained approximately 18% chromium with variations in the nickel, copper, nitrogen and lanthanum. The desired molybdenum content was achieved by using split heats. These heats were employed along with additional samples, including conventional commercial alloys. The heats were processed by casting 17-pound ingots which were held at 2100° F. for two hours. They were then forged into sheet bar of $3\frac{1}{2}\times\frac{7}{8}''\times$length. After conditioning they were heated at 2200° F. for one hour and then hot rolled to 0.250" hot band. The hot band was heated at 2150° F. for one half hour and then water quenched. After shot blasting and pickling the material was cold rolled to 0.125" strip, which was heated for 15 minutes at 2150° F. and water quenched. The material was then cold rolled to achieve a further reduction to 0.060" strip, which strip was heated at 2150° F. for 10 minutes, water quenched, shot blasted and pickled.

TABLE I sets forth the chemical composition of these heats as well as the other alloys used for evaluation. Also listed in TABLE I are the results of the microstructural evaluation of the alloys.

TABLE I

CHEMICAL COMPOSITION AND MICROSTRUCTURE OF EXPERIMENTAL ALLOYS

| | Weight Percent | | | | | | | | | | | Microstructure[2] |
|---|---|---|---|---|---|---|---|---|---|---|---|---|
| | C | Mn | S | P | Si | Cu | Cr | Ni | Mo | N | Other | |
| Heat No. | | | | | | | | | | | | |
| Type - Laboratory Heats | | | | | | | | | | | | |
| | | | | | | | 18 Cr 16 Ni | | | | | |
| 3D37 | .027 | 1.50 | .005 | .015 | .41 | 0.07 | 18.30 | 16.10 | 4.10 | .023 | | A |
| 3D38 | 1 | | | | | | 18.57 | 16.10 | 5.51 | | | A + LS |
| 3D39 | 1 | | | | | | 18.47 | 15.95 | 7.52 | | | A + HS |
| | | | | | | | 18 Cr 16 Ni N | | | | | |
| 3D24 | .020 | 1.63 | .005 | .016 | .46 | 0.08 | 18.47 | 15.25 | 3.54 | .13 | | A |
| 3D21 | .018 | 1.44 | .005 | .017 | .46 | 0.08 | 18.21 | 15.82 | 4.02 | .12 | | A |
| 3D25 | 1 | | | | | | 18.99 | 15.32 | 4.12 | .13 | | A |
| 3D22 | 1 | | | | | | 18.43 | 16.13 | 4.57 | .11 | | A |
| 3D26 | 1 | | | | | | 18.98 | 15.39 | 5.29 | .13 | | A + LS |
| 3D23 | 1 | | | | | | 18.45 | 15.97 | 5.69 | .12 | | A + MS |
| | | | | | | | 18 Cr 20 Ni | | | | | |
| 3D40 | .028 | 1.57 | .006 | .010 | .29 | 0.08 | 17.64 | 20.18 | 4.03 | .022 | | A |
| 3D41 | 1 | | | | | | 17.93 | 20.30 | 5.43 | | | A + MS |
| 3D42 | 1 | | | | | | 17.88 | 20.05 | 7.19 | | | A |
| | | | | | | | 18 Cr 20 Ni La | | | | | |
| 3D46 | .025 | 1.54 | .003 | .013 | .38 | 0.08 | 17.48 | 19.86 | 4.03 | .023 | La 0.07 | A |
| 3D47 | | | | | | | 17.68 | 19.82 | 5.78 | .024 | La 0.04 | A |

TABLE I-continued

CHEMICAL COMPOSITION AND MICROSTRUCTURE OF EXPERIMENTAL ALLOYS

| | Weight Percent | | | | | | | | | | | Microstructure[2] |
|---|---|---|---|---|---|---|---|---|---|---|---|---|
| | C | Mn | S | P | Si | Cu | Cr | Ni | Mo | N | Other | |
| 3D48 | | | | | | | 17.53 | 19.58 | 7.37 | .023 | La 0.009 | A + HS |
| | | | | | | | 18 Cr 18 Ni Cu | | | | | |
| 3D43 | .016 | 1.49 | .005 | .013 | .36 | 2.03 | 17.66 | 18.14 | 4.27 | .031 | | A |
| 3D44 | [1] | | | | | 2.07 | 18.10 | 18.37 | 5.89 | | | A + LS |
| 3D45 | [1] | 1.36 | | | | 2.07 | 17.99 | 18.30 | 7.07 | | | A + HS |
| | Competitive Alloys | | | | | | | | | | | |
| 3983 | .020 | 1.80 | .011 | .013 | .56 | 0.14 | 25.25 | 25.20 | 3.78 | .022 | B 0.001 | A |
| 3C14 Sandvik 2RE69 | .018 | 1.72 | .011 | .013 | .51 | | 25.32 | 22.80 | 2.21 | .12 | B 0.0006 | A + LS |
| 3C 15 Haynes MOD 20 Grade | .014 | 1.66 | .014 | .014 | .56 | | 21.43 | 25.37 | 5.58 | | Ti 0.22 | |
| | Commercial Steels | | | | | | | | | | | |
| 90840 (AL 6X) | | | | | | | 20.00 | 24.00 | 6.00 | | | A + LS |
| 6X | | | | | | | 20.80 | 25.58 | 6.21 | | Ce 0.0074 La 0.0042 | A + LS |
| JS700 | .03 | 1.70 | | | | | 21.00 | 25.00 | 4.50 | | Cb 0.30 | A |
| 904L | .02 | 1.75 | | | | 1.40 | 20.00 | 25.00 | 4.50 | | | A |
| 20Cb3 | .04 | 1.70 | | | | 3.50 | 20.00 | 33.70 | 2.50 | | Cb 0.35 | A |
| 316L | .025 | 1.70 | | | | | 17.00 | 12.50 | 2.25 | | | A |
| 317L | .025 | 1.70 | | | | | 18.40 | 13.20 | 3.20 | | A | |

[1]Not Analyzed, Split Heat
[2]A = Austenite
LS = Light Second Phase
MS = Medium Second Phase
HS = Heavy Second Phase For purposes of crevice corrosion testing, test specimens were prepared by making autogenous gas tungsten arc cross-welds on the samples and then cutting them into 1"×3" test specimens. A hole was drilled at the cross in the welds. The surfaces of the specimens were ground with a 120 grit belt, cleaned, measured and weighed. Serrated teflon blocks were fastened to the specimen with titanium bolts and uniformly tightened with a torque wrench. The tests evaluate the base metal, heat-affected zone and the weld. The tests were performed in a solution of synthetic seawater containing 1% potassium ferricyanide. The test temperatures were 86° F. and 104° F. for 120 or 124 hours, respectively. Weight loss per square inch of specimen, as well as visual examination of the specimen, were the evaluation criteria.

TABLE II lists the results of the corrosion tests conducted at 86° F. Each alloy tested was ranked according to weight loss. Alloys displaying no weight loss were ranked according to the degree of etching or discoloration as determined by visual and macroscopic examination.

TABLE II

CREVICE CORROSION TEST RESULTS IN SYNTHETIC SEAWATER*

| Heat | Nominal Composition, Weight % Cr | Ni | Mo | Others | Wt. Loss Mg/sq. in. | Rank | Order |
|---|---|---|---|---|---|---|---|
| 3D48 | 17.53 | 19.58 | 7.37 | La .009 | 0 | 1 | Best |
| 3D26 | 18.98 | 15.39 | 5.29 | N .13 | 0 | 2 | |
| 3D23 | 18.45 | 15.97 | 5.69 | N .12 | 0 | 3 | |
| 3D47 | 17.68 | 19.82 | 5.78 | La .04 | 0 | 4 | |
| 20Cb-3 | 20.00 | 33.70 | 2.50 | Cu 3.5 Cb 0.35 | 1.3 | 5 | |
| 3982 (6X) | 20.34 | 25.05 | 6.24 | | 1.7 | 6 | |
| 3D25 | 18.99 | 15.32 | 4.12 | N .13 | 2.4 | 7 | |
| 3D41 | 17.93 | 20.30 | 5.43 | | 4.3 | 8 | |
| 3D46 | 17.48 | 19.86 | 4.03 | La .07 | 4.8 | 9 | |

TABLE II-continued

CREVICE CORROSION TEST RESULTS IN SYNTHETIC SEAWATER*

| Heat | Nominal Composition, Weight % Cr | Ni | Mo | Others | Wt. Loss Mg/sq. in. | Rank | Order |
|---|---|---|---|---|---|---|---|
| 3D44 | 18.10 | 18.37 | 5.89 | Cu 2.07 | 6.0 | 10 | |
| JS700 | 21.00 | 25.00 | 4.50 | Cb .30 | 6.4 | 11 | |
| 3D45 | 17.99 | 18.30 | 7.07 | Cu 2.07 | 6.6 | 12 | |
| 3D42 | 17.88 | 20.05 | 7.19 | | 6.7 | 13 | |
| 3D39 | 18.47 | 15.95 | 7.52 | | 7.1 | 14 | |
| UD904L | 20.00 | 25.00 | 4.50 | Cu 1.5 | 8.2 | 15 | |
| 3D21 | 18.21 | 15.82 | 4.02 | N .12 | 8.3 | 16 | |
| 3D43 | 17.66 | 18.14 | 4.27 | Cu 2.03 | 8.3 | 17 | |
| 3D38 | 18.57 | 16.10 | 5.51 | | 9.3 | 18 | |
| 3D24 | 18.47 | 15.25 | 3.54 | N .13 | 9.4 | 19 | |
| 3D37 | 18.30 | 16.10 | 4.10 | | 9.6 | 20 | |
| 3D22 | 18.43 | 16.13 | 4.57 | N .11 | 11.8 | 21 | |
| 3D40 | 17.64 | 20.18 | 4.03 | | 12.0 | 22 | |
| 317L | 18.40 | 13.20 | 3.20 | | 13.5 | 23 | |
| 316L | 17.00 | 12.50 | 2.25 | | 22.4 | 24 | Poorest |

*Synthetic Seawater containing 1% potassium ferricyanide 30° C. (86° F.) - 120 hours.

As may be seen from the results presented on TABLE II with alloys containing nominally 4% molybdenum, nitrogen addition was beneficial from the corrosion resistance standpoint. Alloys containing 4.5 to 5.5% molybdenum in combination with nitrogen were superior to the commercial austenitic stainless steels tested. With respect to the alloys containing 18 to 20% nickel, at all the molybdenum levels tested, copper provided no benefit from the chloride corrosion standpoint. A lanthanum addition to these alloys was beneficial at all molybdenum levels tested. Specifically, a small lanthanum addition to the 5.7% molybdenum-containing steel (3D47) resulted in better crevice corrosion resistance than alloys 6X, JS700 and UD904L. Little benefit is obtained by increasing molybdenum above about 7%. However, the nitrogen or lanthanum modified alloys containing more than 5.25% molybdenum are more resistant to crevice corrosion than the higher nickel Cb-3 or 6X alloys. Similar with regard to the 40° C. test data of TABLE III this shows that again increasing the molybdenum is beneficial but there is little benefit in using more than about 5.5% molybdenum.

TABLE III

CREVICE CORROSION TEST RESULTS IN SYNTHETIC SEAWATER CONTAINING 1% $K_3Fe(CN)_6$ - 40° C. (104° F.)

| Alloy | Nominal Composition (Weight Percent) Cr | Ni | Mo | Others | Weight Loss (mg/in.$^2$) 124 hrs. | 120 hrs. | Average | Rank |
|---|---|---|---|---|---|---|---|---|
| 90840 (AL6X) | 20.0 | 25.0 | 6.0 | — | 1.1 | — | 1.1 Best | 1 |
| 3D48 | 17.5 | 19.5 | 7.37 | La .009 | 1.7 | 3.0 | 2.3 | 2 |
| 3982 (6X) | 20.0 | 25.0 | 6.24 | — | 1.1 | 4.1 | 2.6 | 3 |
| 3D26 | 19.0 | 15.0 | 5.29 | N .13 | 1.9 | 3.6 | 2.8 | 4 |
| 3D47 | 18.0 | 20.0 | 5.78 | — | 1.5 | 5.1 | 3.3 | 5 |
| 3C15 (Haynes) | 21.0 | 25.0 | 5.58 | Ti .2 | 3.4 | — | 3.4 | 6 |
| Comm 6X | 21.0 | 25.0 | 6.21 | — | 4.1 | — | 4.1 | 7 |
| 3983 | 25.0 | 25.0 | 3.78 | — | 4.4 | 4.7 | 4.5 | 8 |
| 3D23 | 18.0 | 16.0 | 5.69 | N .12 | 4.8 | — | 4.8 | 9 |
| 3C14 (Sandvik) | 25.0 | 23.0 | 2.21 | — | 5.6 | — | 5.6 | 10 |
| 20Cb3 (Carpenter) | 20.0 | 34.0 | 2.5 | Cu 3.5 | 6.6 | 6.2 | 6.4 Poorest | 11 |

In TABLE IV The compositions of three heats are reported; all are of essentially the same composition except for the lanthanum and cerium contents. Heat 3G31A contains essentially no lanthanum or cerium; Heat 3G28A contains lanthanum but no cerium; and Heat 3G29A contains cerium but essentially no lanthanum. From ingots of each of the heats reported in TABLE IV hot bands were produced by conventional practice including hot rolling from a temperature of 2275° F. After hot rolling the hot band from each heat was examined for edge cracking. From this examination, a bar graph constituting the single FIGURE of the drawing was prepared. This FIGURE shows that the lanthanum-containing Heat (3G28A) exhibits significantly less edge cracking than the lanthanum- and cerium-free heat (3G31A) and the cerium-containing heat (3G29A).

TABLE V summarizes weight loss corrosion test data for annealed hot bands from the heats of TABLE IV alloys in both boiling 10% sulfuric acid ($H_2SO_4$) and crevice corrosion tests using acidified 10% ferric chloride ($FeCl_3$). In the former test the lanthanum-containing alloy exhibits about one half the weight loss than either of the other two alloys. The results were similar in the crevice corrosion tests reported on TABLE V.

TABLE V

EFFECT OF LANTHANUM AND CERIUM ON THE WEIGHT LOSS CORROSION OF AUSTENITIC STAINLESS STEEL

| Heat Number | Weight Loss (mg/in.$^2$) 10% $H_2SO_4$ 120 Hours Boiling | Crevice Corrosion Acidified 10% $FeCl_3$ 24 Hours 37.5° C. | 120 Hours 46° C. | 55° C. |
|---|---|---|---|---|
| 3G31A | 500 | 0.5 | 9.9 | 17.6 |
| 3G28A (0.013% La) | 292 | 0.2 | 6.3 | 13.9 |
| 3G29A (0.026% Ce) | 525 | 0.7 | 9.2 | 19.5 |

We claim:

1. An austenitic stainless steel having good corrosion resistance in chloride environments at relatively low nickel and molybdenum levels, said steel consisting essentially of, in weight percent, carbon 0.01 to 0.1, manganese 12 max., silicon 1 max., chromium 15 to 25, nickel greater than 16 to 25, molybdenum 3 to 7, a rare earth element consisting of lanthanum 0.005 to 0.05, nitrogen 0.1 to 0.50 and balance iron.

2. The steel of claim 1 having copper up to about 3%.

3. The steel of claim 1 having 0.1 to 0.3% nitrogen.

4. The steel of claim 1 having manganese 3% max.

5. The steel of claim 1 having molybdenum within the range of 3 to 5.5%.

6. The steel of claim 1 having nickel within the range greater than 16 to 20%.

7. An austenitic stainless steel having good corrosion resistance in chloride environments at relatively low nickel and molybdenum levels, said steel consisting essentially of, in weight percent, carbon 0.01 to 0.1, manganese 12 max., silicon 1 max., chromium 15 to 25, nickel greater than 16 to 20, molybdenum 3 to 5.5, a rare earth element consisting of lanthanum 0.005 to 0.05, nitrogen 0.1 to 0.50 and balance iron.

8. The steel of claim 7 having manganese 3% max.

9. The steel of claim 7 having copper up to about 3%.

* * * * *

TABLE IV

CHEMICAL COMPOSITION OF LANTHANUM- AND CERIUM-CONTAINING HEATS

| Heat Number | Weight Percent C | Mn | S | Si | Cr | Ni | Mo | N | La | Ce | Fe |
|---|---|---|---|---|---|---|---|---|---|---|---|
| 3G31A | .038 | 1.74 | .010 | .58 | 20.60 | 18.04 | 5.87 | .24 | .001 | N.D. | Bal. |
| 3G28A | .035 | 1.74 | .005 | .65 | 20.25 | 17.89 | 5.90 | .26 | .013 | N.D. | Bal. |
| 3G29A | .030 | 1.73 | .006 | .67 | 20.53 | 17.96 | 5.87 | .25 | .001 | .026 | Bal. |

N.D. = Not Detected